US006179653B1

(12) United States Patent
Cheng et al.

(10) Patent No.: US 6,179,653 B1
(45) Date of Patent: Jan. 30, 2001

(54) STACKING COMPUTER CONNECTOR

(75) Inventors: Andy Cheng; Daniel Sheu, both of Taoyuan shian (TW)

(73) Assignee: Simula Co. Ltd. (TW)

( * ) Notice: Under 35 U.S.C. 154(b), the term of this patent shall be extended for 0 days.

(21) Appl. No.: 09/534,131

(22) Filed: Mar. 23, 2000

(51) Int. Cl.[7] ..... H01R 13/60
(52) U.S. Cl. ..... 439/541.5; 439/717
(58) Field of Search ..... 439/79, 80, 541.5, 439/717

(56) References Cited

U.S. PATENT DOCUMENTS 5,709,554 * 1/1998 Savage, Jr. ..... 439/56
6,080,011 * 6/2000 Tsao et al. ..... 439/541.5

* cited by examiner

*Primary Examiner*—Steven L. Stephan
*Assistant Examiner*—Thanh-Tam Le

(74) *Attorney, Agent, or Firm*—Jacobson, Price, Holman & Stern, PLLC

(57) ABSTRACT

A stacking computer connector primarily comprises a connection board, a bottom connector and a top connector. The connection board includes a plurality of sets of through holes. The bottom connector is mounted on the connection board, and several protruding pins at the bottom surface of the bottom connector is locked in one set of the through holes, and the bottom connector has a dovetail-shaped seat on the top thereof. The top connector is piled upon the bottom connector, and the protruding pins are locked in another set of the through holes, and the top connector includes an accommodation space at the front bottom end thereof which has a dovetail-shaped groove on the top thereof. In accordance with the foregoing structure, the above-mentioned bottom connector is fitted in the accommodation space of the top connector. Therefore, the dovetail-shaped seat on the top of the bottom connector can be locked in the dovetail-shaped groove of the top connector. Accordingly, the bottom connector and the top connector can be connected with each other integrally in order to facilitate the assembly thereof on a motherboard and to reduce the occupied area of the motherboard.

2 Claims, 3 Drawing Sheets

STACKING COMPUTER CONNECTOR

BACKGROUND OF THE INVENTION

1. Field of the Invention

The present invention relates to a stacking computer connector, and more particularly, to a stacking computer connector including a connection board, a bottom connector and a top connector, wherein the top and bottom connector are integrally mounted into the connection board for saving the available area for circuit of adapter cards on the motherboard.

2. Description of the Prior Art

The main components of computer include motherboard and various kinds of adapter cards such as video graphic adapter card, sound blaster card, floppy disk controllers, and COM controllers which have been the standard equipment now. Before, when purchasing the computer, users needed to choose adapter cards at the same time thus caused some inconvenience and the cost also increased. For cost-down, above-mentioned adapter cards are mounted on the motherboard by manufactures nowadays.

Due to the disposition of adapter cards on the motherboard, connectors of adapter cards also need to be mounted on the motherboard so that the available area for disposing the circuit of adapter cards is reduced and the arrangement of the circuit of adapter cards is getting difficult.

SUMMARY OF THE INVENTION

It is a primary object of the present invention to solve the aforesaid problem by providing a stacking computer connector in which the top and bottom connector are connected to each other more integrated and more compact in order to save the available area for arranging the circuit of adapter cards on the motherboard.

According to the above object, the stacking computer connector of the present invention includes a connection board, a bottom connector and a top connector. The connection board has a plurality of sets of through holes. The bottom connector is mounted on the connection board, and several protruding pins at the bottom surface of the bottom connector is locked in one set of the through holes, and the bottom connector has a dovetail-shaped seat on the top thereof. The top connector is piled upon the bottom connector, and the protruding pins are locked in another set of the through holes, and the top connector includes an accommodation space at the front bottom end thereof which has a dovetail-shaped groove on the top thereof. In accordance with the foregoing structure, the above-mentioned bottom connector is fitted in the accommodation space of the top connector. Therefore, the dovetail-shaped seat on the top of the bottom connector can be locked in the dovetail-shaped groove of the top connector. Accordingly, the bottom connector and the top connector can be connected with each other integrally in order to facilitate the assembly thereof on a motherboard and to reduce the occupied area of the motherboard.

The present invention can be best understood through the following description and accompanying drawings, wherein:

DETAILED DESCRIPTION OF THE PREFERRED EMBODIMENT

Figure 1:
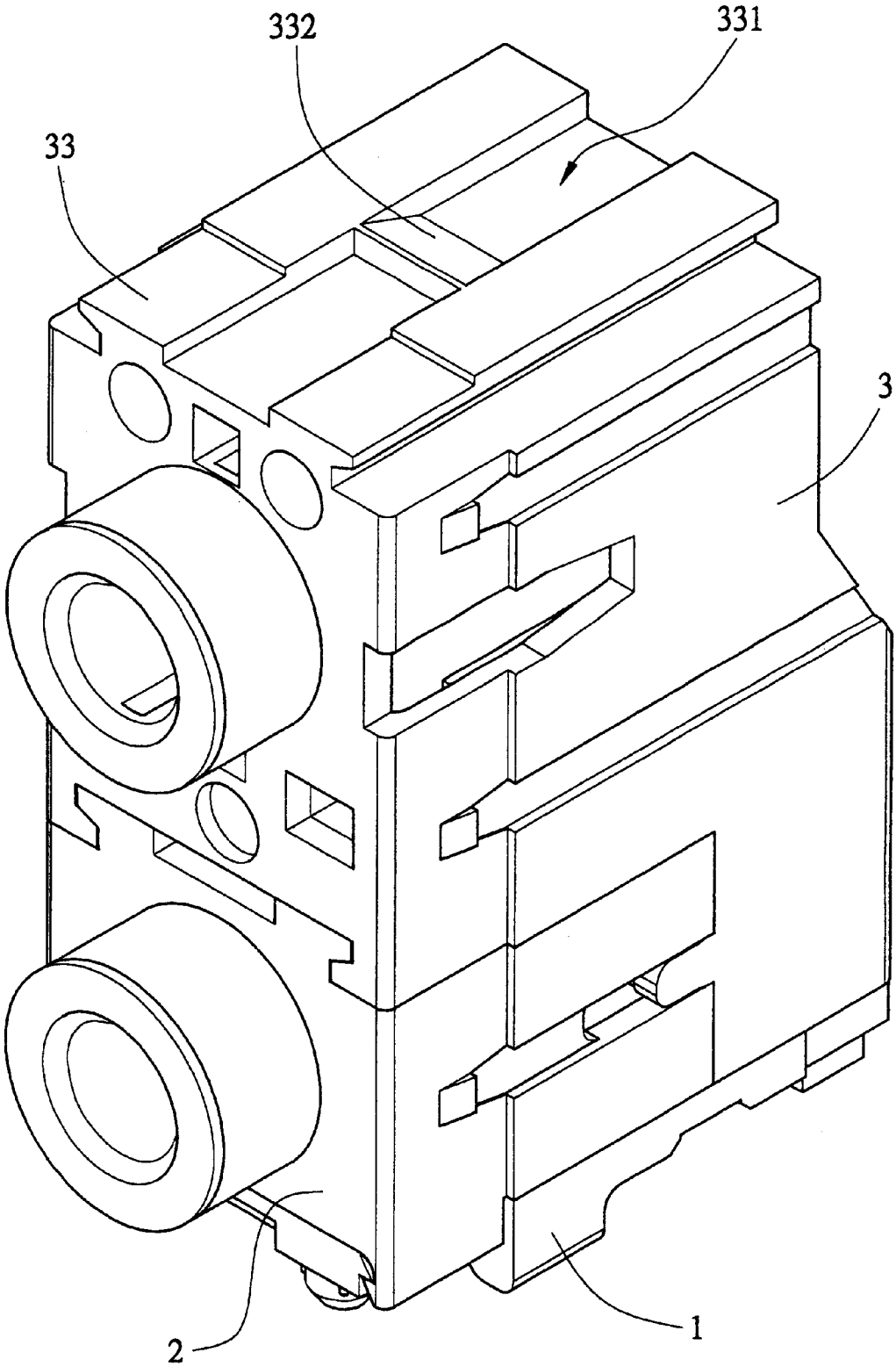
FIG. 1 is a perspective view of the present invention
Figure 2:
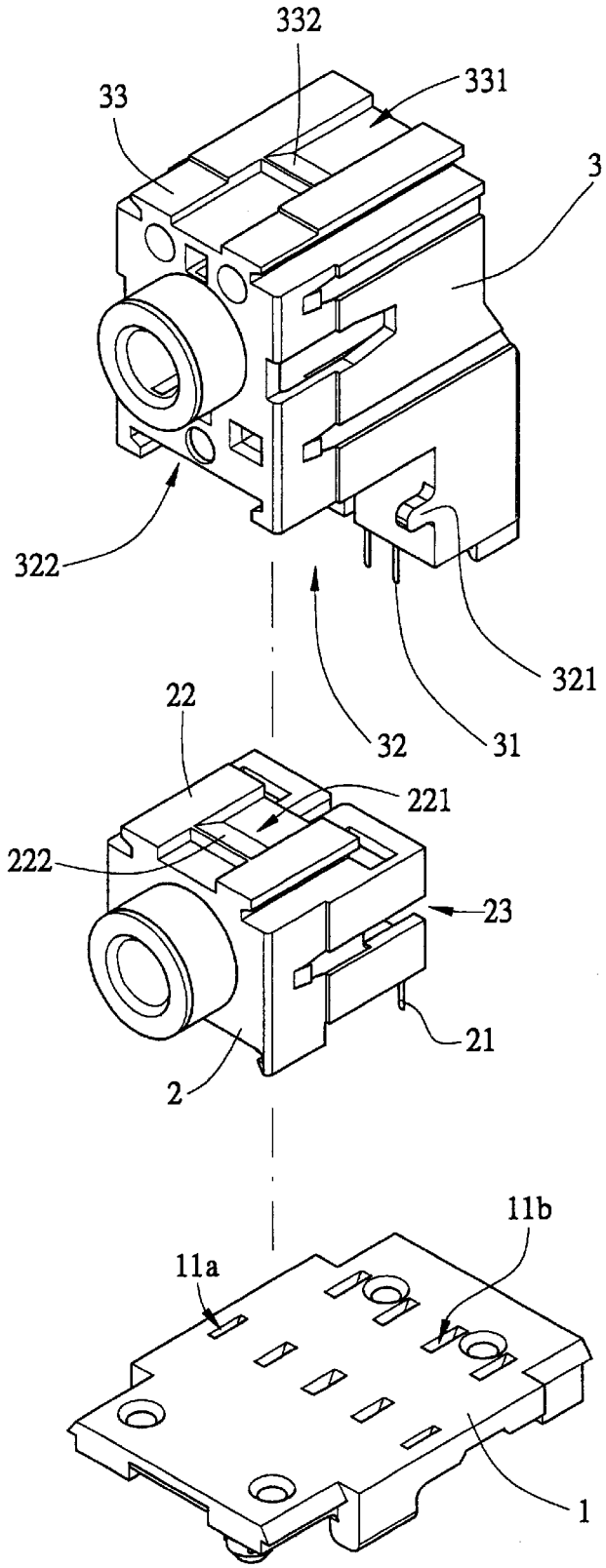
FIG. 2 is an exploded view of the present invention

First of all, referring to FIGS. 1 and 2, a stacking computer connector in accordance with the present invention includes a connection board 1, a bottom connector 2 and a top connector 3, wherein the invention is characterized by:

the connection board 1 having two sets of through holes 11*a*, 11*b;* the bottom connector 2 being mounted on the connection board 1, protruding pins 21 at the bottom surface of the bottom connector 2 being locked in one set of through holes 11*a* of the connection board 1, said bottom connector 2 having a dovetail-shaped seat 22 at the top surface thereof, an open groove 221 being disposed at the center of the bottom connector 2, the open groove 221 having an inverted hook 222 therein, a locating slot 23 respectively disposed at two side of the bottom connector 2; and the top connector 3 being piled upon the bottom connector 2, a protruding pin 31 of the top connector 3 being inserted into another set of through holes 11*b* of the connection board 1, the top connector 3 having an accommodation space 32 at front bottom end thereof, the accommodation space 32 having a protruding piece 321 respectively at two sides thereof, the accommodation space 32 having a dovetail-shaped groove 322 on the top thereof, a top hook 323 being disposed within the dovetail-shaped groove 322.

Figure 3:
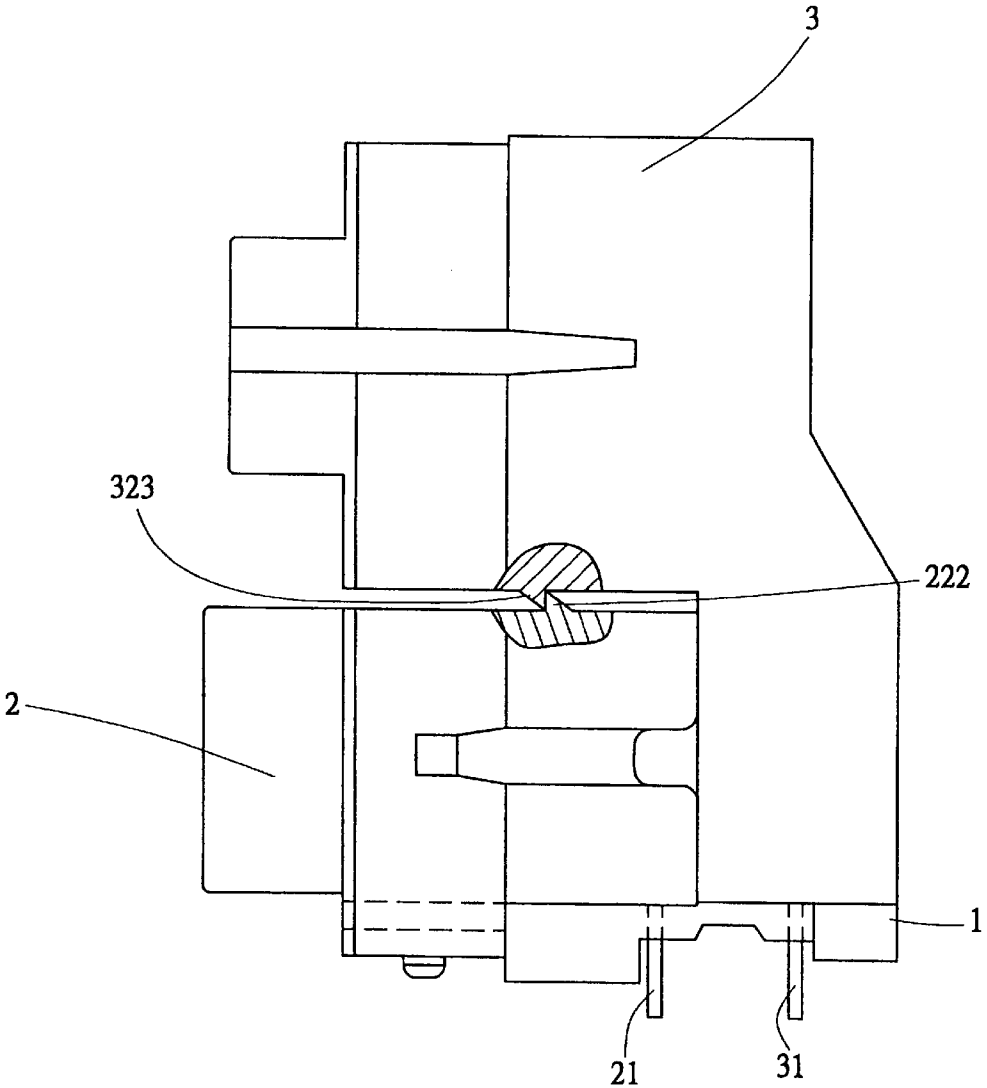
FIG. 3 is an assembling view of the present invention

In accordance with the above-mentioned structure, the foregoing bottom connector 2 is mounted on the connection board 1. Thereafter, the top connector 3 is piled upon the bottom connector 2. As the top connector 3 includes an accommodation space 32, the bottom connector 2 can be connected into the accommodation space 32 of the top connector 3 while the dovetail-shaped seat 22 at the top of the bottom connector 2 can be inserted into the dovetail-shaped groove 322 of the top connector 3. In addition, the top hook 323 within the dovetail-shaped groove 322 of the top connector 3 can be hooked with the inverted hook 222 of the dovetail-shaped seat 22 of the bottom connector 2, as shown in FIG. 3. The protruding pieces 321 at two sides of the accommodation space 32 of the top connector 3 can be inserted into the locating slots 23 at two sides of the bottom connector 2. Accordingly, the top connector 3 can be mounted on the top of the bottom connector 2 while the top connector 3 and the bottom connector 2 are installed on the connection board 1.

Since the bottom connector 2 is locked in the accommodation space 32 of the top connector 3 so that the top connector 3 can be piled on the top of the bottom connector 2. When it is installed on the motherboard (not shown), the occupied area of the motherboard can be therefore reduced.

Furthermore, the top connector 3 can fitted with a dovetail-shaped seat 33 on the top thereof, if necessary. The dovetail-shaped seat 33 includes a longitudinal groove 331 which is fitted with an inverted hook 332 so that another connector (not shown) with similar structure to the top connector 3 on the bottom thereof can be piled thereon. Accordingly, a plurality of connectors can be continuously piled up in order to reduce the occupied area.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A stacking computer connector comprising:

a connection board having a plurality of sets of through holes;

a bottom connector being mounted on said connection board, a protruding pin at the bottom of said bottom connector being locked in one set of through holes of said connection board, said bottom connector having a dovetail-shaped seat at the top thereof, an open groove being disposed at the center of said bottom connector, said open groove having an inverted hook therein, a locating slot respectively disposed at two sides of said bottom connector; and a top connector being piled upon said bottom connector, a protruding pin of said top connector being inserted into another set of through holes of said connection board, said top connector having an accommodation space at front bottom end thereof, said accommodation space having a protruding piece respectively at two sides thereof, said accommodation space having a dovetail-shaped groove on the top thereof, a top hook being disposed within said dovetail-shaped groove;

wherein said bottom connector can be connected into said accommodation space of said top connector while said dovetail-shaped seat at the top of said bottom connector can be inserted into said dovetail-shaped groove of said top connector, and said top hook within said dovetail-shaped groove can be hooked with said inverted hook of said dovetail-shaped seat, and wherein said protruding pieces at two sides of said accommodation space of said top connector can be inserted into said locating slots at two sides of said bottom connector so that said top connector can be mounted on the top of said bottom connector.

2. The stacking computer connector as claimed in claim 1, wherein said top connector includes another dovetail-shaped seat in order to mount a further connector thereon.

* * * * *